US005215301A

United States Patent [19]

Oshino et al.

[11] Patent Number: 5,215,301

[45] Date of Patent: Jun. 1, 1993

[54] STACKER

[75] Inventors: Genzi Oshino; Katsuhiko Obata, both of Miyagi, Japan

[73] Assignee: Tohoku Ricoh Co., Ltd., Miyagi, Japan

[21] Appl. No.: 853,275

[22] Filed: Mar. 18, 1992

[30] Foreign Application Priority Data

Mar. 20, 1991 [JP] Japan ..... 3-81824

[51] Int. Cl.[5] ..... B65H 31/08

[52] U.S. Cl. ..... 271/212; 271/176; 271/224

[58] Field of Search ..... 271/212, 224, 176

[56] References Cited

U.S. PATENT DOCUMENTS 3,998,451 12/1976 McInerny ..... 271/212

4,968,023 11/1990 Huggins ..... 271/212

*Primary Examiner*—Richard A. Schacher

*Attorney, Agent, or Firm*—Armstrong, Westerman, Hattori, McLeland & Naughton

[57] ABSTRACT

In a stacker, where a stopper for aligning the front end of the papers to be stacked being detachable within a bottom plate of a paper receiver by a magnetic force, a paper feed means being provided along the paper feed direction in a manner such that the feed surface projects slightly above the bottom plate, a projection being provided at the bottom of the stopper in a manner such that it extends in parallel with the feed surface while not projecting above the feed surface of the feed belt, thereby letting the stopper moveable at any position along the paper feed direction in order to adjust the paper feed depth corresponding to the length of the fed papers, the papers can be fed by the feed belt and stacked without fail and further the stacked papers can be taken out by raising the stopper from the bottom plate while the stacked papers are raised by the projection.

13 Claims, 9 Drawing Sheets

STACKER

FIELD OF THE INVENTION

This invention is directed to a stacker into which a plurality of papers is successively fed and stored when each paper is stopped by a stopper at its front edge. The stacker is utilized in a copying machine, printer, ticket dispenser, card dispenser and others.

DESCRIPTION OF THE PRIOR ART

There is a known stacker for stacking a plurality of papers fed out of a copying machine, a printer and others wherein the stacker includes a paper receiver having a bottom plate, a side plate and a stopper positioned on the bottom plate for limiting the paper feed distance, and a paper feed means for feeding a plurality of papers into the paper receiver along the top surface of the bottom plate; thereby, stopping each paper by the stopper fed by the paper feed means for successively stacking the plurality of papers from bottom to top.

The stacker of this kind is, for example, disclosed in each of the specification of U.S. Pat. Nos. 4,943,043, 4,968,022 and 4,968,023. In the stacker, the stopper for limiting the feed distance of the hopper or the paper receiver, is provided with saw-like teeth while similar teeth are also provided on the top surface of the bottom plate such that the stopper is fixed at the desired position on the bottom plate by engaging the corresponding saw-like teeth.

In the stacker of this structure, however, the positioning of the stopper can only be adjusted in accordance with the pitch length of the saw-like teeth of the stopper and it is impossible to provide a fine or small adjustment along the paper receiving direction. Moreover, the engagement of the corresponding saw-like teeth is easily dislocated by the vibration or by the impact of the fed papers. Further, the front edge of the paper may be caught between the saw-like teeth.

Further, since only a pair of rollers are provided at the entrance of the paper receiver as a paper feed means for feeding a new paper under the stacked papers, the new paper fed out of the printer is fed by the pair of rollers while rubbing the bottom plate and is stopped by the stopper. Therefore, as the number of the stacked papers increases, so does the frictional resistance due to the weight of the stacked papers, and it becomes more difficult to feed a new paper until the front edge thereof abuts the stopper by overcoming the resistance and eventually becomes impossible to stack. Further, for papers or cloths of soft and thin nature, there is a problem of feeding a new sheet by rollers under the stacked papers being impossible to accomplish.

Moreover, in the conventional stacker, since it was not easy to detach the stopper out of the bottom plate, so as to be able to take out the whole amount of stacked papers, only a small amount of stacked papers could be taken out from the top at first and several steps were necessary. Further, when the stacked papers were taken out by inserting the hand to the bottom of the stacked papers, they tended to be disorganized.

Moreover, if the printed paper was unable to be cut and stacked as in a case when there are labels with starch, it was difficult to take out the stopper for leasing the elongated paper and therefore, it was necessary to take out the whole stacker itself from the printer.

Further, since the conventional stacker was provided with a paper press means for pressing the stacked papers only at the entrance side of the hopper, when lengthy and curly paper was to be stacked, the paper tended to curl upward when it was stopped by the stopper and became impossible to be stacked.

If, in order to suppress the curling, a part of the paper pressing means is extended toward the backward direction of the stacker (stopper direction) or if, in order to widen the width of the papers to be stacked, the width of the paper pressing means is widened along the direction traverse to the paper feed direction at a right angle (hereinafter referred to as a width direction), the more the curled top end of the paper is apart from a guide groove to the backward direction of the stacker or the more the pressed paper is apart from the guide groove to the width direction, the more the friction between the guide groove and a resin part of the paper pressing means increases since the paper pressing means is subjected to an inclined force and eventually, it becomes impossible to stack the papers because the paper pressing means cannot ascend any further. This is because the paper pressing means in the conventional stacker has the resin part which slides along the guide groove provided at the side plate.

In the conventional stacker, a stack full sensor (switch) was provided for detecting a predetermined height of the paper pressing means to generate a signal for stopping the receiving papers and since the position of the stackful sensor was fixed, it was impossible to adjust the height of the stack full height.

SUMMARY OF THE INVENTION

The present invention is aimed to eliminate the various problems in the conventional stacker and has for its object to stack papers without fail regardless of the thickness or the length of the papers so as to easily take out the stacked papers and to adjust the position of the stopper with ease and with certainty in accordance with the length of the papers.

Another object of the present invention is to enable stacking lengthy and curly papers without fail and adjusting the stacking height by a stack full sensor which emits a stop signal to stop receiving the papers by sensing the upward movement of the paper pressing means.

In order to perform this, the stacker of the present invention is provided with a paper receiver having a bottom plate, a side plate, and a stopper installed on the bottom plate to restrict the feed depth, a paper feed means for feeding a paper into the paper receiver along the top surface of the bottom plate, and means for successively accumulating the papers from the bottom by stopping the papers by the stopper. The stacker has a structure as described below.

The stopper for aligning the front ends of the papers is detachably placed on the bottom plate which forms the paper receiver by a magnetic force, and a feed belt as a feed means is provided at the bottom plate along the feed direction in a manner such that the feed surface is slightly projected above the bottom plate, and a projection is provided at the lower end of the stopper such that it extends in parallel with the feed surface without projecting upwardly above the feed surface.

Accordingly, it is possible to precisely adjust the feed depth of the paper receiver in accordance with the length of the papers by moving the stopper at any position along the feed direction in order to stack the papers by feeding them by a feed belt without fail, and to easily take out the stacked papers by pulling the stopper out of the bottom plate while the projection sustains the stacked papers from the bottom.

In order for the stopper to adhere on the bottom plate by magnetic force, the bottom plate can be made, for example, by a strong magnetic material while a magnet can be provided at the bottom of the stopper.

Further, a groove or a projection may be provided at the bottom plate in parallel with the feed direction while a projection or a recess is also provided at the bottom of the stopper in order to engage them together such that the position of the stopper can be restrained along the direction traverse to the feed direction at a right angle. The movement of the stopper is easily performed since the groove or the projection is simply engaged with the projection or the recess.

The magnet can also be movably positioned along the upward and downward directions within the stopper, and a magnet positioning switch mechanism can also be provided such that the magnet can take either a high position apart from the bottom plate and a lower position close to it.

Further, a paper press means can be movably provided at a side plate along the up and down direction, so as to press the stacked papers on the bottom plate of the paper receiver, from the top surface thereof, along both the paper feed direction and the direction traverse thereto at a right angle in order to stack lengthy and curly papers without fail. This is more effective if another paper press means is provided at the stopper movably along up and down directions in order to press the front end portion of the papers, with another paper press means being operative together with the previous paper press means.

Provided at the side plate is an upwardly and a downwardly movable stack full sensor which emits a signal to stop receiving the papers into the paper receiver by detecting the predetermined position of the paper press means. The detecting position of the stack full height can be adjusted by a sensor fixing means positioned at any desirable height.

The above and other objects, features and advantages of the invention will be apparent from the following detailed description which is to be read in conjunction with the accompanying drawings.

DETAILED DESCRIPTION OF THE PREFERRED EMBODIMENTS

The embodiment of the invention is described hereinafter with reference to the drawings.

Figure 1:
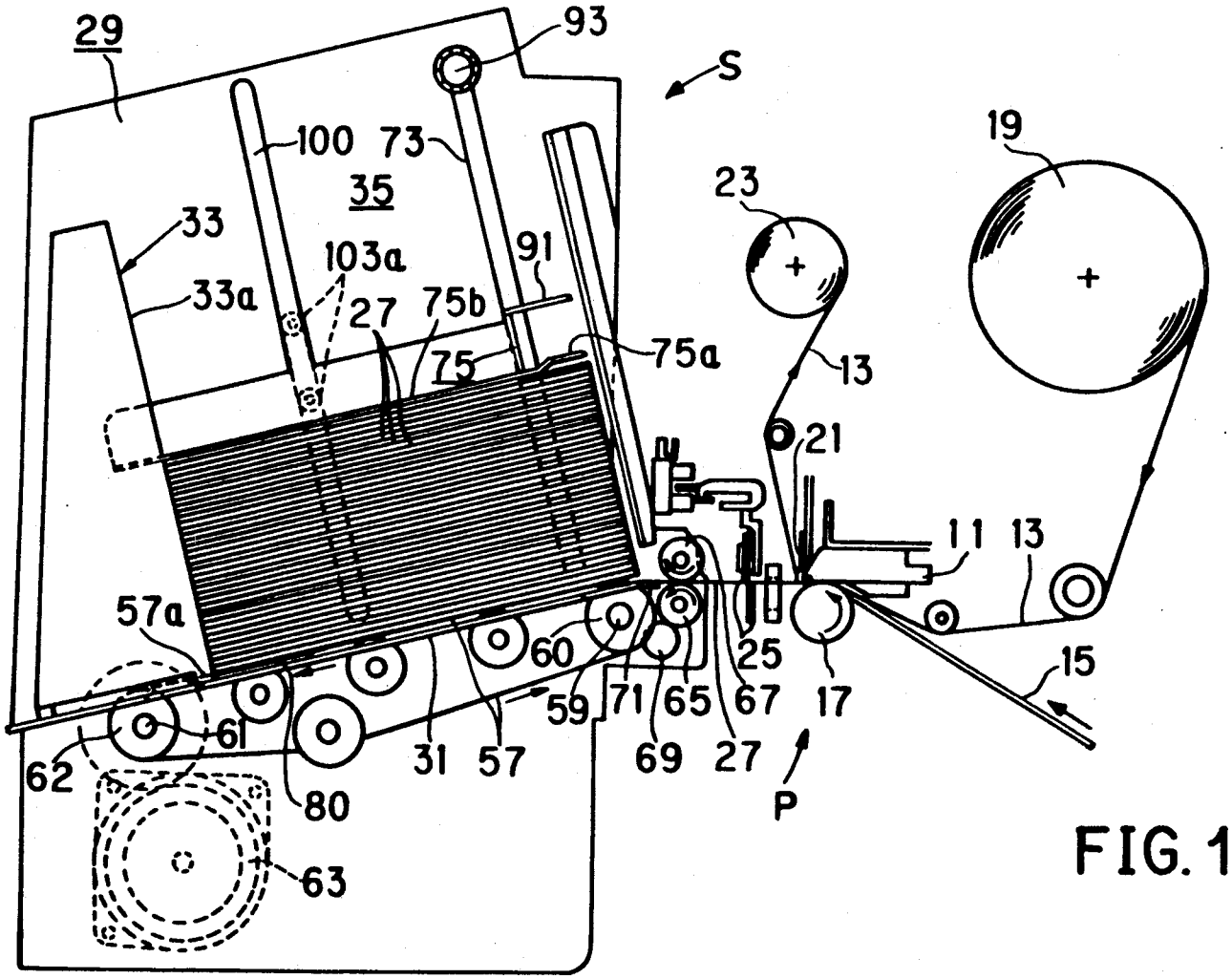
FIG. 1 shows a side view of a schematic structure of a stacker of one embodiment of the invention attached to a printer in which the detailed structure is omitted.

FIG. 1 shows a schematic view of the structure in which a stacker of one embodiment of the invention is installed in the printer. Printer P in which the stacker is attached is shown only by its substantial portion.

As to printer P, it is provided with thermal head 11 which prints on roll paper 15 by platen 17 through thermo-transfer ribbon 13. The roller paper 15 is rolled at a position (not shown) and is pulled out by platen 17 toward a leftward direction in the drawings, and a print is recorded on its surface.

On the other hand, thermo transfer ribbon 13 is fed out of feed bobbin 19 and taken up by take-up bobbin 23 after it is pealed out of roll paper 15 by peal-off plate 21. Printed roll paper 15 is cut by a cutter 25 by a predetermined length into a sheet of paper 27 which is sent to stacker S.

Figure 2:
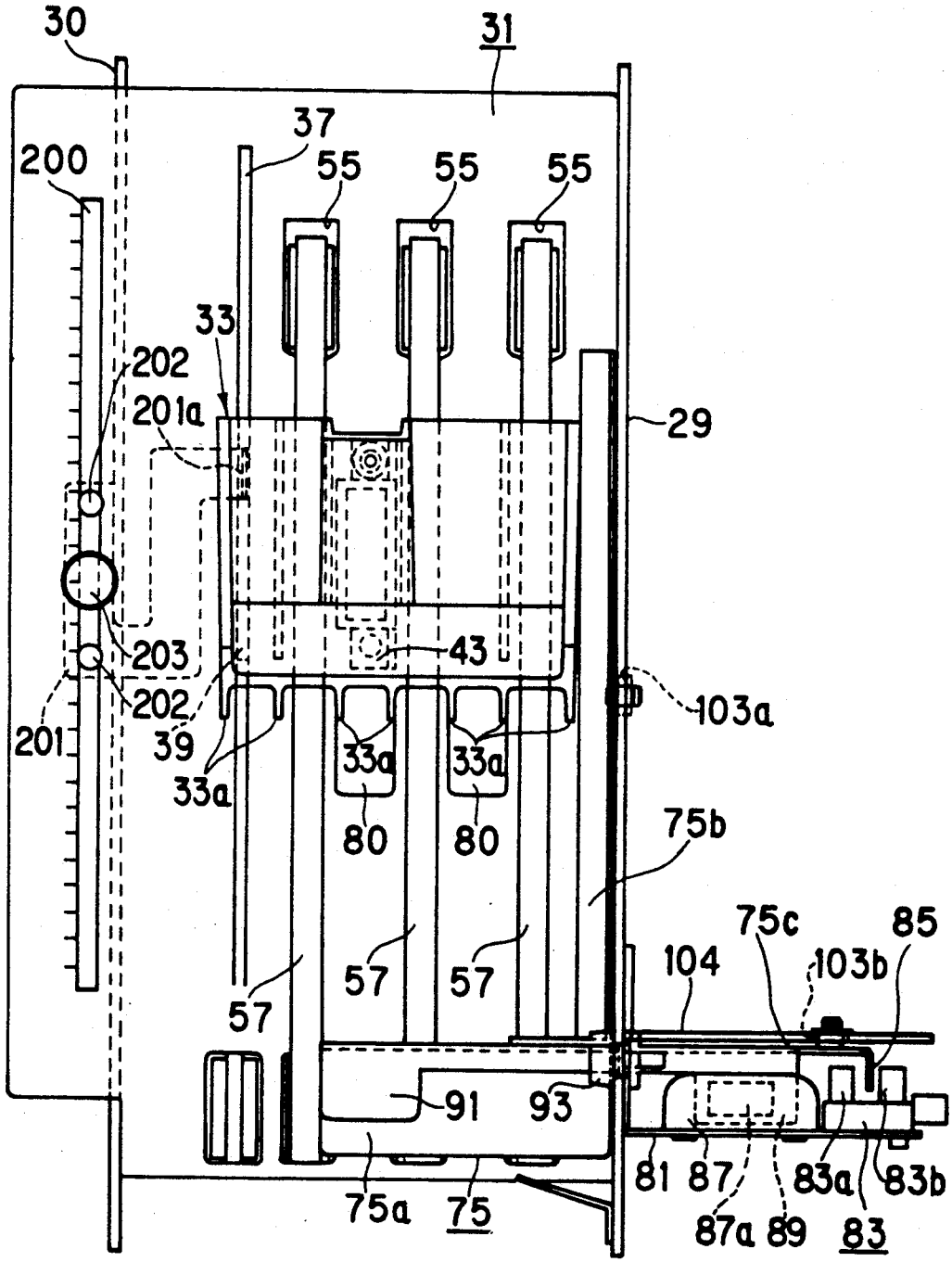
FIG. 2 shows a plane view of the stacker.

Stacker S forms paper receiver 35 having a pair of side plates 29 and 30 (the front side plate is eliminated in FIG. 1) elected in parallel from each other with a predetermined distance therebetween, as shown in FIGS. 1 and 2, bottom plate 31 being gradually inclined along the paper feed direction, as shown in FIG. 1 and being across the pair of the side plates at a right angle, and stopper 33 positioned on bottom plate 31 for limiting the feed depth.

One of side plates 29 extends above bottom plate 31 higher than the maximum height of the stacked papers while another side plate 30 is provided only at the downstream side of the bottom plate such that paper receiver 35 opens at the front side in FIG. 1 (at the left side in FIG. 2).

Provided within paper receiver 35 is a paper feed means (explained later) for feeding papers 27 along the top surface of bottom plate 31, wherein the paper feed means is intended to successively stack the papers from the bottom by letting the front ends of the papers abut at paper abut surface 33*a* of stopper 33 in order to align the front ends.

Figure 3:
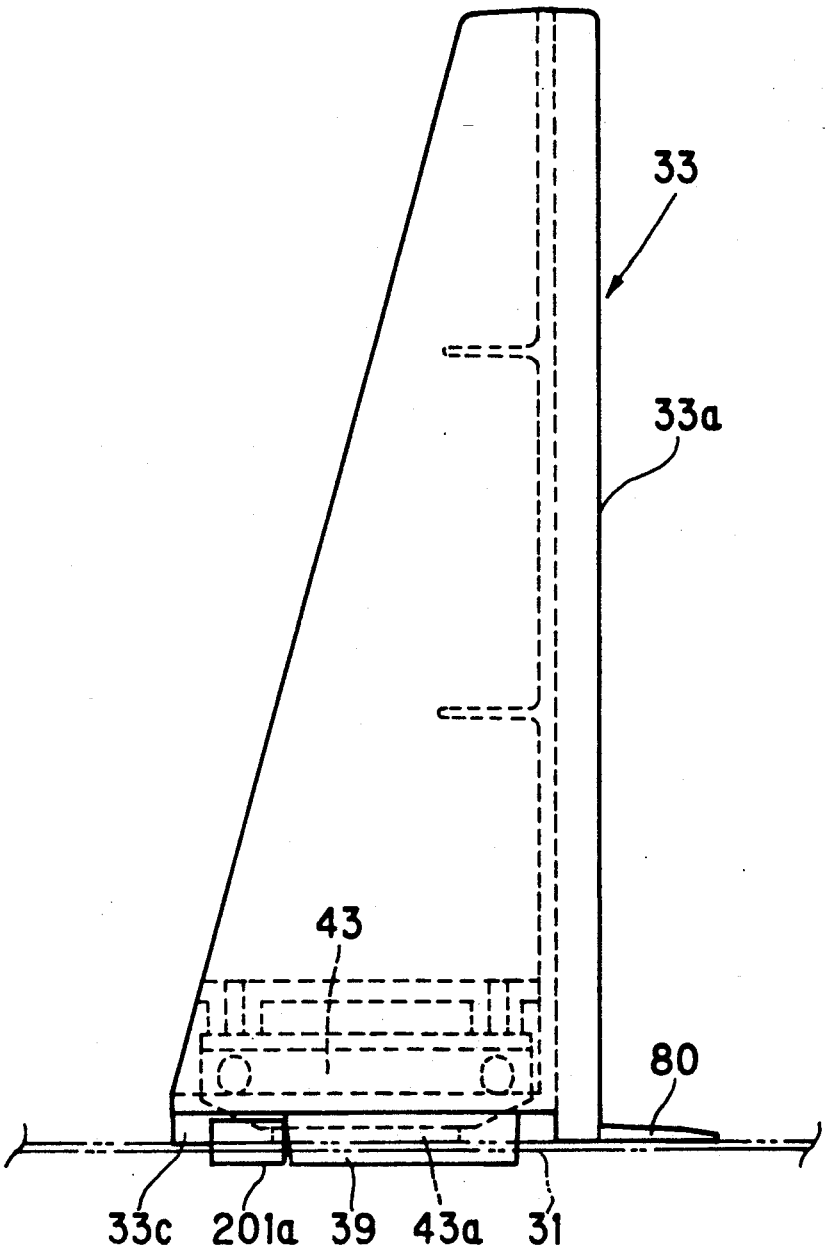
FIG. 3 shows a side view of a stopper.
Figure 4:
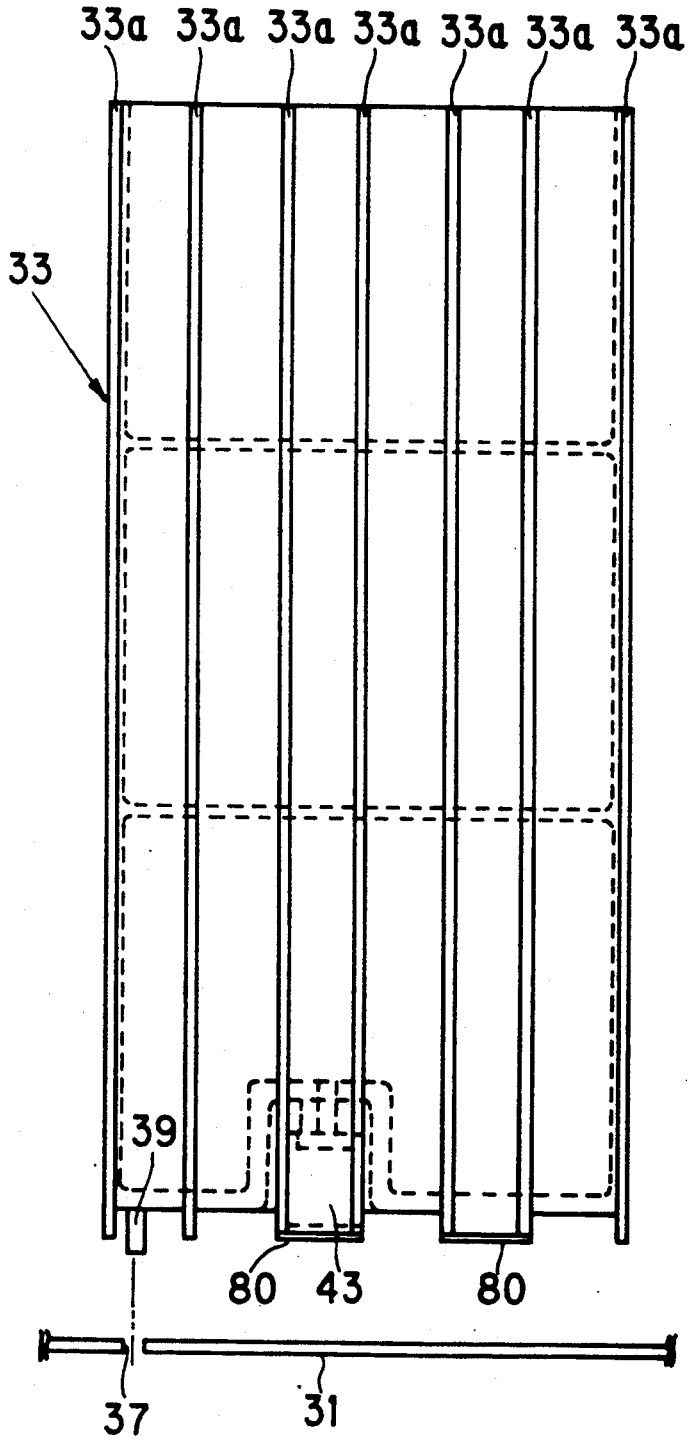
FIG. 4 shows a front view of the stopper.

Stopper 33 is a molding product made by resin or others, the paper abut surface 33*a* of which is formed by the front ends of a plurality of ribs extending upright from bottom plate 31 and being in parallel with each other with a predetermined clearance therebetween, as shown in FIGS. 2–4.

Bottom plate 31 made of a strong magnetic material (such as an iron plate) is provided with two rows of V-shape groove 37 along the receiving direction (in parallel with side plate 29) of papers 27 (as shown in FIGS. 2 and 4) and stopper 33 is provided, at its bottom, with projection 39 engaging with groove 37 (FIGS. 3 and 4).

Further, magnet 43 equipped with magnetic piece 43*a* is fixed at the bottom side of stopper 33, as shown by dotted line in FIGS. 2 and 3.

In the bottom plate 31, another groove 200 is provided at the outside of side plate 30 in parallel with groove 37. Pins 202 are fixed or rivetted, on stopper positioning device 201 arranged under the bottom surface of bottom plate 31 and slides within grooves 200.

Knob 203 is fixed on stopper positioning device 201 by a screw fashion through groove 200 from the top surface of bottom plate 31. By tightening knob 203, bottom plate 31 is held between stopper positioning device 201 and knob 203 so that stopper positioning device 201 is fixed on bottom plate 31.

Fixed on positioning device 201 is hook 201*a* which extends into the inside portion of side plate 30 through a slit (not shown) provided between side plate 30 and bottom plate 31. The top end of hook 201*a* is bent upwardly and inserted in and extended out of groove 37 and abuts with projection 39 provided under stopper 33 and inserted within groove 37.

Adhering force between magnet piece 43*a* of magnet 43 and bottom plate 31 is determined at the level such that stopper 33 can slide within groove 37 of bottom plate 31 along the paper feed direction. Also, a scale is provided along one edge of groove 300 to show the length or the size of the paper capable to be stacked on bottom plate 31. Thus, when knob 203 is loosened to move positioning devise 201 along groove 200 and then tightened up after aligning the center of knob 203 with a certain position of the scale corresponding to the length of the papers to be stacked, positioning device 201 and a block 201*a* thereof are fixed at the position.

After that consequently, stopper 31 is adhered to bottom plate 31, moved along the paper feed direction while projection 39 being inserted into groove 37 until projection 39 abuts with hook 201*a* where the positions of paper abut surface 33*a* of stopper 33 along both the paper feed direction and the direction traverse to the direction at a right angle (hereinafter referred to as "width direction") are fixed there. Thus, the feed depth of paper receiver 35 can be adjusted at any length. In this case, it is desirable if projection 39 of stopper 33 is engaged with groove 37 of bottom plate 31 since the position of stopper 33 is limited along the above-mentioned width direction, therefor although, it is not always necessarily so. For example, if stopper 33 or a member integral with stopper 33 is made contacting with side plate 29 at all times (i.e., if side plate 30 is made detachable or capable of being open-and-close toward an upward direction from bottom plate 31, it is acceptable with respect to side plate 30), the position along the width direction is also limited.

Further, if the upper portion of stopper 33 is pushed and inclined toward a leftward direction around rear lower end 33*c* as a pivot point in FIG. 3, it is easily detached from bottom plate 31 by overcoming the adhering force between magnet 43 and bottom plate 31.

Further, bottom plate 31 is provided with three elongated slits 55 along the paper feed direction, as shown in FIG. 2, and along each of which feed belt 57 is also provided. Each of the three feed belts 57 is suspended around each pulley 60 fixed on common axis 59 and around each pulley 62 fixed on axis 61 in a manner such that feed surface 57*a* of each feed belt slightly projects above bottom plate 31 and is driven by drive motor 63 along a counter-clockwise direction (along the arrow) as shown in FIG. 1.

Positioned immediately in front of each feed belt 57 are roll-in roller 65 and pinch roller 67 which hold paper 27 fed out of printer P in order to feed it into paper receiver 35. Roll-in roller 65 is driven by idle gear 69 which is driven by a gear (not shown) and fixed on pulley axis 59 of feed belt 57.

Although roll-in roller 65 is driven by a gear (not shown) and fixed on axis 59 of pulley 60 through idle gear 69 in this embodiment, it can be directly driven by a timing belt or the like without through idle gear 69. Alternatively feed belt 57 can be extended up to the position of roll-in roller 65 so as to directly roll in and feed paper 27.

The aforementioned structural arrangement of the paper feed means is thus provided. Moreover, guide plate 71 is provided, as shown in FIG. 1, in order to smoothly receive paper 27 fed while being held therebetween roll-in roller 65 and pinch roller 67. Also, provided at the bottom of stopper 33 is a pair of projections 80 which flushes with feed surface 57*a* of feed belt 57 without projecting thereabove and runs in parallel therewith.

Projection 80 is positioned below feed surface 57*a* of feed belt 57 when stopper 33 is adhered to bottom plate 31 by magnet 43 such that fed-out paper 27 is not hindered by projection 80 and is instead fed on the upper surface thereof.

Therefore, according to this embodiment, paper 27 fed out of printer P is held between roll-in roller 65 and pinch roller 67 and is fed into beneath the bottom side of the bottom paper, if there is any, within paper receiver 35. It is fed by feed belt 57 in such a manner that it slightly floats above bottom surface 31 until it hits paper abut surface 33*a*.

Thus, papers 27 fed out of printer P are successively accumulated from the bottom within paper receiver (i.e., the successively coming paper is accumulated under the forward by fed paper) and are stacked.

When the stopper 33 is raised by one hand from a viewer's side, the front ends of stacked papers 27 within paper received 35 are also raised since they are positioned on projection 80. If stopper 33 is taken out from stacker S while lightly pressing the top surface of stacked papers 27 by another hand, all stacked papers 27 can be taken out in the printed order without being disorganized.

Even when paper 27 is comparatively long along its longitudinal direction or soft, all the stacked papers can be taken out by one operation if stopper 3 is slightly raised, and on the other hand, is inserted under the bottom paper raised by projection 80 from bottom plate 31, and is then taken out of the stacker.

Figure 5:
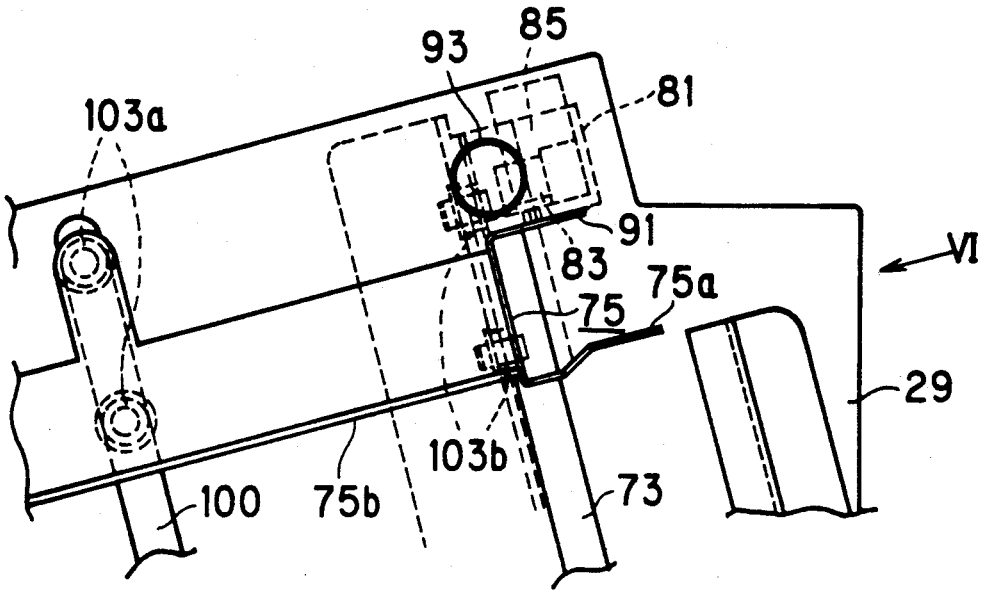
FIG. 5 shows a partially enlarged view when a paper pressing means 75 in FIG. 1 reaches a position where it is detected by a stack full sensor.
Figure 6:
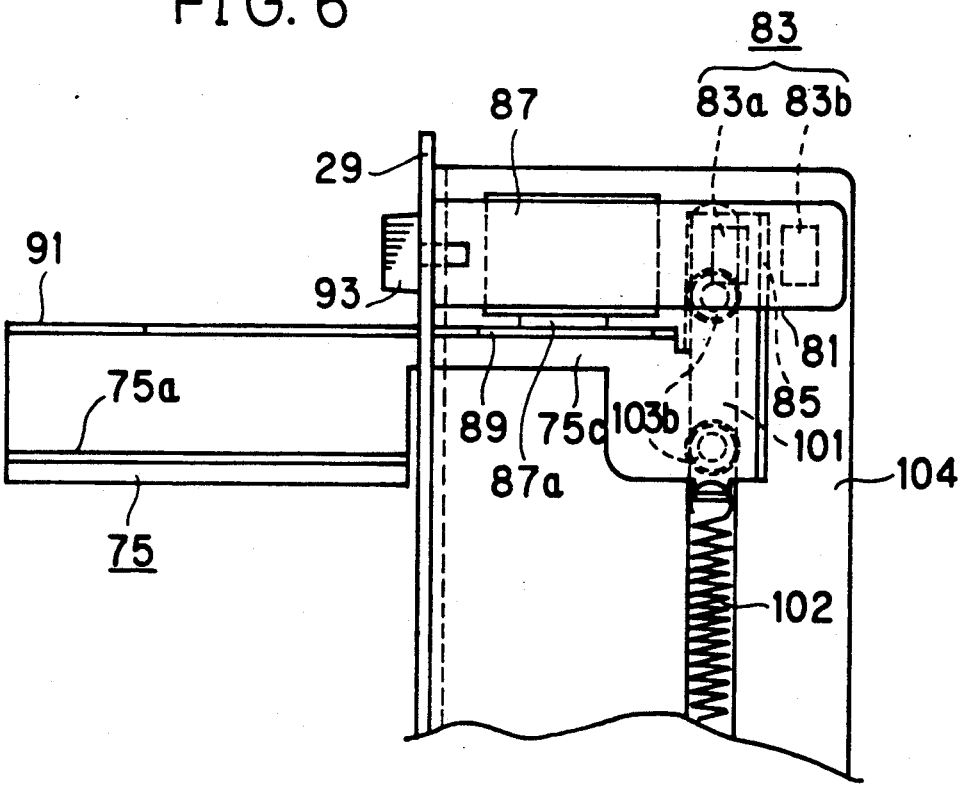
FIG. 6 shows a view taken from an arrow VI.

Next, the stack full sensor and other part installed in this embodiment are hereinafter described with reference to FIGS. 1, 2, 5 and 6. FIGS. 5 and 6 show stacker S when the paper receiver 35 thereof is filled with the papers.

This stacker S is provided with paper press 75 positioned slidably along an up and down direction on side plate 29. Paper press 75 presses stacked papers 27 from the top portion, along the paper feed direction, thereof and the traverse direction thereto at a right angle (width direction).

Paper press 75 is a sort of a weight made of a metal plate or the like, and is equipped with main body portion 75*a* extending traverse to the paper feed direction (width direction), an extension portion 75*b* having an L-shaped cross-section and extended toward the paper feed direction from main body portion 75*a* along side plate 29, and arm piece 75*c* extending toward the outside through slit 73 provided in side plate 29 and running along the direction traverse to the bottom plate 31 at a right angle.

Two ball bearings 103*a*, 103*a* are provided along a vertical direction with a certain distance therebetween roughly at the center of extension portion 75*b* of paper press 75, and are rotatably inserted in first guide groove 100 provided at side plate 29 and extending along a direction vertical to bottom plate 31 in which first guide groove 101 two ball bearings 103*b*, 103*b* are rotatably inserted.

Also, provided at near the end of arm piece 75*c* are two ball bearings 103*b*, 103*b* along a vertical direction with a certain distance therebetween, as shown in FIG. 6. On the other hand, at the outside of side plate 29, there is provided a guide plate 104 vertical thereto, and a second guide groove 101 is formed in guide plate 104 along a direction vertical to bottom plate 31 where two ball bearings 103*b*, 103*b* are rotatably inserted.

Thus, paper press 75 smoothly moves in upward and downward directions by rotatable movement of four balls 103*a* and 103*b* along guide groove 100 provided at the center of side plate 29 and guide groove 104 provided at the outside of side plate 29. Therefore, since there occurs only a small amount of resistance due to rolling contact between guide grooves 100, 101 and paper press 75, paper press 75 smoothly moves upward no matter where extension portion 75*b* of paper press 75 contact paper 27 by its upward curling or no matter how much the width of paper 27 increases; thereby, main body portion 75*a* of paper press 75 contacting paper 27 at a position distant from its support portion.

Further, in this the paper press 75, as shown in FIG. 6, tension spring 102 is provided between arm piece 75*c* extending outwardly from side plate 29 and an extension portion (not shown) of bottom plate 31 of stacker S such that all stacked papers 27 along the feed direction within paper receiver 35 are pressed by their own weights and compulsory by tension spring 102; thereby, preventing them from dislocating toward the viewer's side and the side of roll-in roller 65 by vibration.

Paper press 75 is moved upward by the increasing thickness of the stacked papers as they are stacked. Moreover, the paper receive side (the right-hand portion in FIG. 5) of main body portion 75*a* of paper press 75 is bent upwardly such that the front edge of the first paper fed into does not ride over main body portion 75*a*.

Thus, since stacked papers 27 are pressed along the width direction by main body portion 75*a* of paper press 75; as well as, the feed direction by extension portion 75*b*, the papers are stacked in a correct manner even if they are curled due to being rolled up by a roller.

Stack full sensor and structural elements are hereinafter explained with reference to FIGS. 2, 5 and 6.

At the upper outside of guide groove 73 of side plate 29, bracket 81 is attached by stop screw 93 and stack full sensor 83 (as such photo-interrupter) and other structural elements are attached at bracket 81. Stack full sensor 83 is formed by light emitter 83*a* and light receiver 83*b* positioned in an opposite manner.

On the other hand, in paper press 75, shutter 85 is provided by bending the tip end portion of arm piece 75*c* at a right angle which extends to the outside from the side plate 29. As stacked papers 27 increase in paper receiver 35, paper press 75 is also raised, and shutter 85 eventually moves into the space between light emitter 83*a* and light receiver 83*b* of the stack full sensor 83 which in turn emits a stack full signal in order to stop the printing operation by printer P. Thereafter, drive motor 63 is stopped to stop the stack operation.

Further, bracket 81 is movable toward upward and downward directions along guide groove 73 and can be fixed at any position by stop screw 93 (sensor fixing means) which is large enough to be operated by fingers and provided with a knurling surface to stop slippage. Therefore, the stack full detected height can be adjusted at any position by changing the heights of bracket 81 and stack full sensor 83.

Further, magnet 87 having magnet member 87*a* is fixed at bracket 81, and adhering member 89 is also provided at arm piece 75*c* of paper press 75 to adhere magnet member 87*a*, as shown in FIG. 6. If paper press 75 is made of a magnetic metal plate (such as, iron plate or the like) adhering member 89 can be integrally provided as described above; however, if it is done otherwise, adhering member 89 of magnetic material may be positioned at arm piece 75*c*.

Further, at the upper portion above main body portion 75*a* of paper press 75, finger hook (or a knob) 91 is provided such that it is easily raised by a finger. Finger hook 91 or the knob can be made of different material and can be fixed separately.

Under this structure, when a bundle of stacked papers 27 is being taken out, paper press 75 is raised by pulling finger hook 91 up by a finger so as to let adhering piece 89 adhere to magnet member 87*a* of magnet 87 and, paper press 75 will not fall downward even if the finger is released. Then stopper 33 is taken out of stacker S while pressing the top surface of stacked papers 27 by another hand, all the stacked papers can be taken out in printed order without the papers 27 positioned on projection 80 of stopper 33 being disorganized.

In this case, if shutter 85 is made long along the vertical direction such that, when the stackful position is detected, adhering member 89 of paper press 75 will not yet adhere magnet member 87*a* of magnet 87 and adhering member 89 adheres magnet member 87*a* of magnet 87 only after paper press 75 is raised, as described above, and the taking-out operation of papers 27 is difficult to proceed.

Further, if in a case where the stacker is not used such that a continuous starched label paper is printed without being cut, paper press 75 can be raised by magnet 87 in order to clear the path.

Next, another embodiment of the present invention is explained hereinafter with reference to FIGS. 7–10, wherein the parts corresponding to those in FIGS. 1–6 are numbered by the same reference numerals and the explanation of these parts are omitted.

Figure 7:
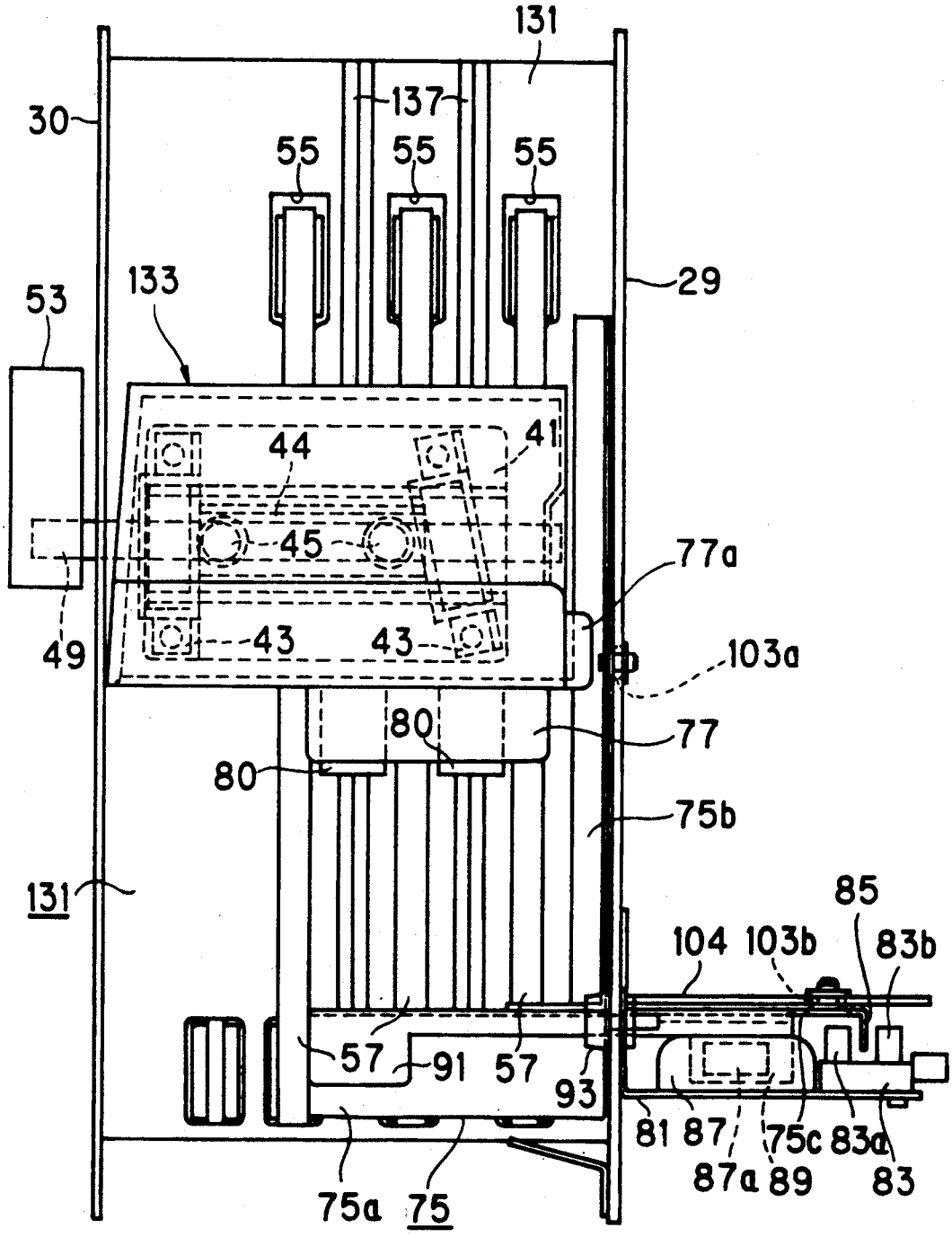
FIG. 7 shows a plane view of a stacker of another embodiment of the invention.
Figure 9:
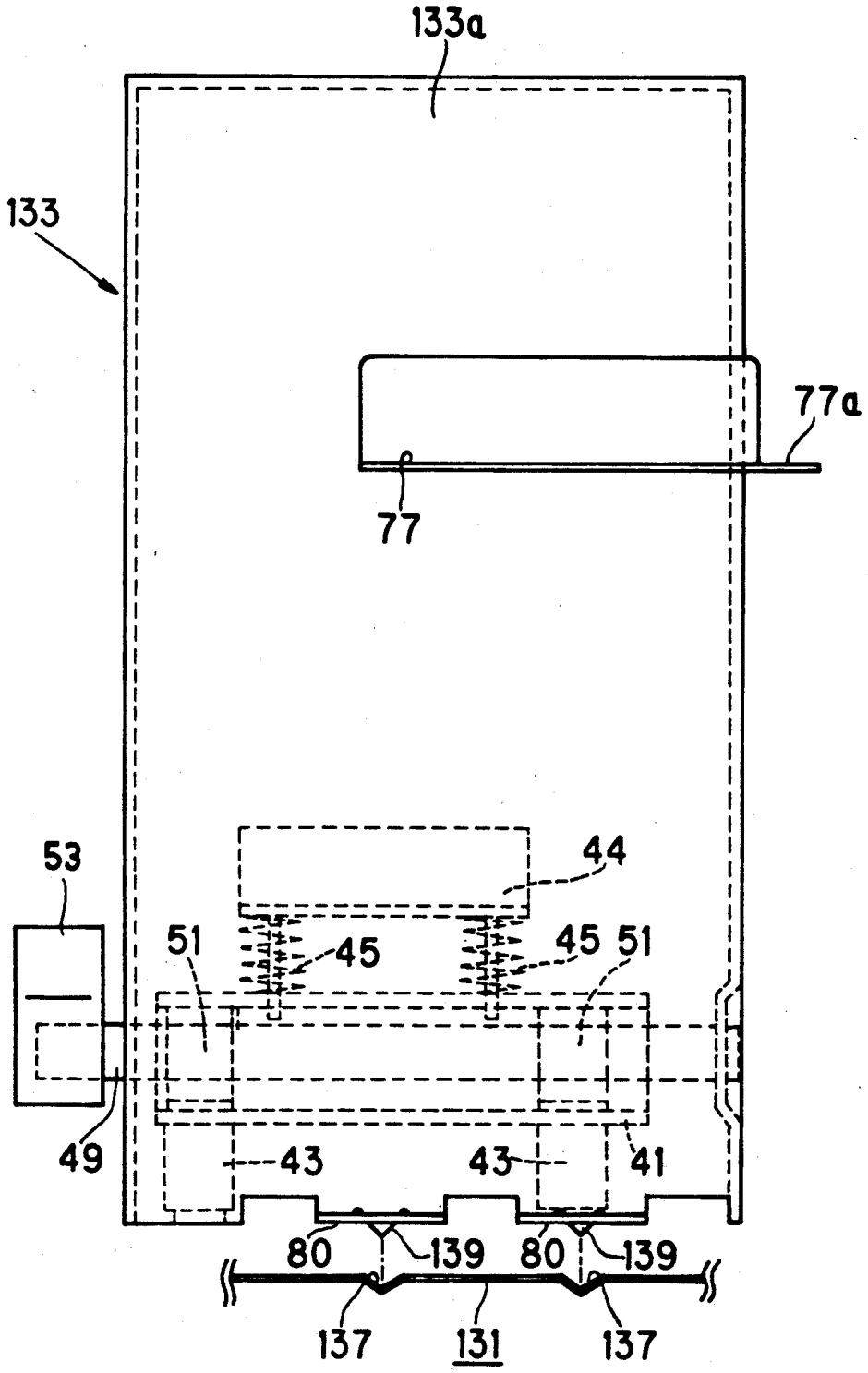
FIG. 9 is a front view of the stopper.

Bottom plate 131 of this embodiment is also made from a strong magnetic member (such as, an iron plate or the like) and is provided with two rows of V-shaped grooves 137 along the paper receiving direction of papers 27, as shown in FIGS. 7 and 9. On the other hand, paper abut surface 133*a* of stopper 133 of this embodiment has a surface vertical to the top surface of bottom plate 131 and is equipped at its bottom with V-shaped projections 139 and 139 each engaging with each of V-shaped grooves 137 and 137 (FIG. 9).

Figure 8:
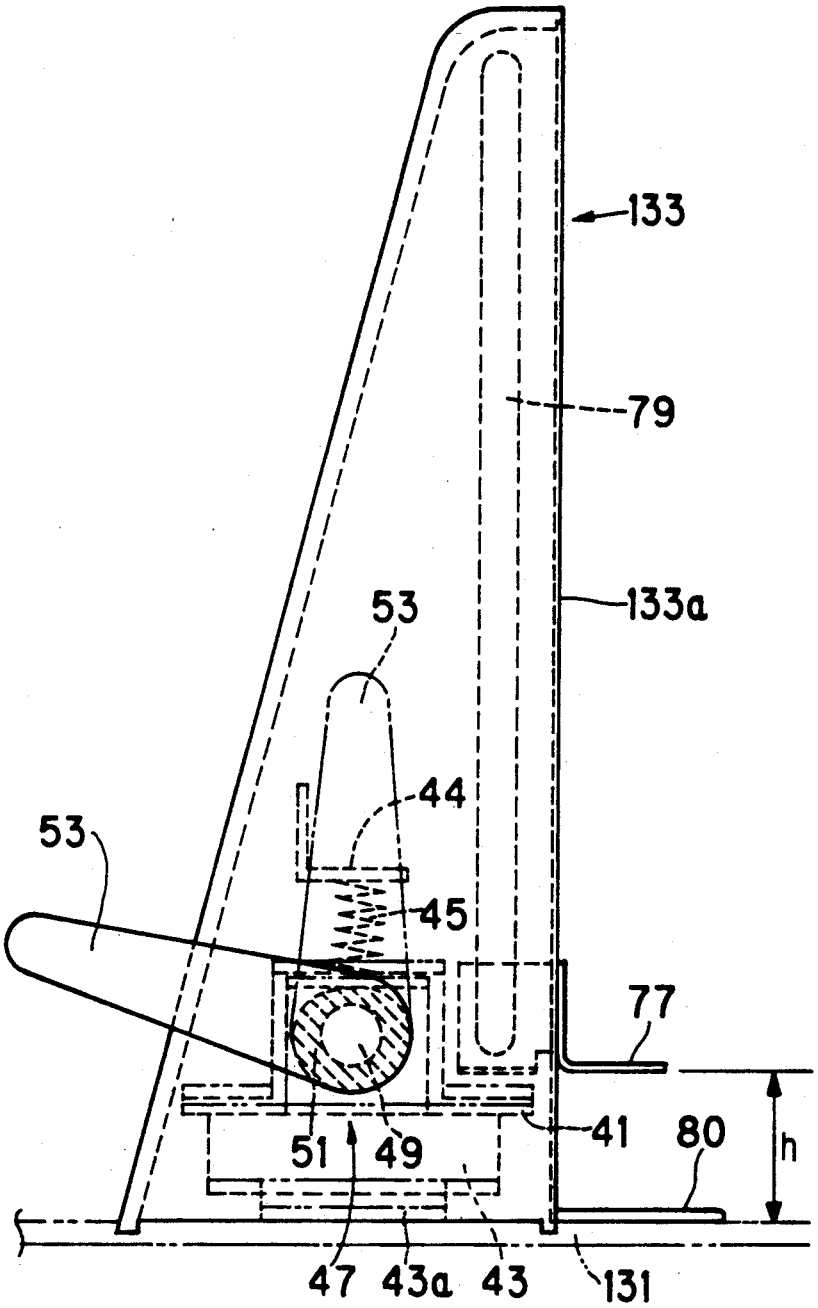
FIG. 8 is a side view of the stopper.

Further, at the bottom of stopper 133, magnet holder 41 is movably suspended along upward and downward directions, as shown by the dotted lines in FIGS. 8 and 9. Two magnets 43 and 43 are fixed at the bottom of magnet holder 41. Reference number 43*a* refers to a magnet member of each magnet 43.

Switch mechanism 47 is also provided in stopper 133 for positioning each magnet 43 at either upward position or downward position. For this, a pair of cams 51 is fixed on an axis 49 rotatably supported in stopper 133 and each contacts the inner surface of each magnet holder 41. Fixed at one end of axis 49 is lever 53 which is operable from outside. Each magnet holder 41 is always pressed upon the cam surface of cam 51 by spring force of a compressed spring 45 attached at L-shaped member 44 fixed within stopper 133.

Having a cylindrical shape eccentric to axis 49, cam 51 moves each magnet holder 41 downward by spring force of spring 45 when lever 53 takes a rotational position indicated by solid line in FIG. 8; thereby, moving each magnet 43 toward bottom plate 131 to adhere and fix thereto.

When lever 53 is rotated to the upward position, as shown by dotted lines in FIG. 8, each cam 51 rotates and pushes each magnet holder 41 up such that each magnet 43 leaves from bottom plate 131 to take an upward position shown by dotted line: thereby, letting stopper 133 become movable along V-shaped groove 137. At this time, the movement of stopper 133 along its width direction is restricted by the engagement between V-shaped grooves 137 and 137 and V-shaped projections 139 and 139.

Therefore, in order to adjust the feed depth of paper receiver 35, lever 53 is moved to take the upper position to thereby release each magnet 43 from bottom plate 131, and stopper 133 is moved along V-shaped groove 137 in the bottom plate up to the adequate position corresponding to the length of papers to be stacked. Then, lever 53 is changed to the lateral position shown by solid line in FIG. 8 and each magnet 43 adheres to bottom plate 131 in order to be fixed there. Therefore, the feed depth in paper receiver 35 can be adjusted at any length corresponding to the length of the papers to be stacked along the feed direction with ease without stepped manner. V-shaped groove 137 in this embodiment can be replaced by a projection on bottom plate 131 with stopper 133 being provided with a recess to receive the projection.

Stacked papers 27 within paper receiver 35 of stacker S can be taken out together with stopper 133 by moving lever 53 of stopper 133 to an upward position shown by dotted line in FIG. 8; thereby, releasing the adherence of magnet 43 out of bottom plate 131.

If the stacked papers are relatively short and soft like a tag paper, the papers can be easily taken out together with stopper 133 by holding them between projection 80 and second paper press 77 to be explained later.

Stopper 133 is also provided with paper press 77. That is, paper press 77 is installed so as to be movable upward-and-downwardly above paper abut surface 133*a* along guide groove 79 extended at the right-hand side of FIG. 9 of stopper 133 in parallel with the paper abut surface 133*a* shown by dotted lines in FIG. 8.

Hereinafter, paper press 77 is referred to as a second paper press while paper press 75 as a first paper press slidably attached at side plate 29 similar to the previous embodiment.

Second paper press 77 is also a sort of weight made of a metal plate or the like, and presses stacked papers 27, within paper receiver 35 at the front and upper sides thereof by its own weight.

Second paper press 77 is also provided with, at its main body portion having L-shaped cross-section moving upward and downwardly along paper abut surface 33*a*, tongue piece 77*a* projecting from the side surface of stopper 133 as shown in FIGS. 7 and 9. Tongue piece 77*a* is placed on extension part 75*b* of first paper press 75 by its weight. Therefore, as first paper press 75 moves upward-and-downwardly, second paper press 77 also moves together.

When curly paper 27 having curling tendency imparted while it has been rolled up by a roller, is fed, second paper press 77 prevents curly paper 27 from being ejected when its tip end tends to be curled upward.

Guide groove 79 is not extended down to bottom plate 131 as shown in FIG. 8; thereby, restricting the bottom position of second paper press 77 with a predetermined height from bottom plate 131. This is to prevent first curly paper 27 from riding on paper press 77 when it is fed from printer P to stacker S. Papers 27 are successively stacked in paper receiver 35 and after the height of stacked paper 27 exceeds h, then second paper press 77 is pushed upward by extension portion 75*b* of first paper press 75.

Figure 10:
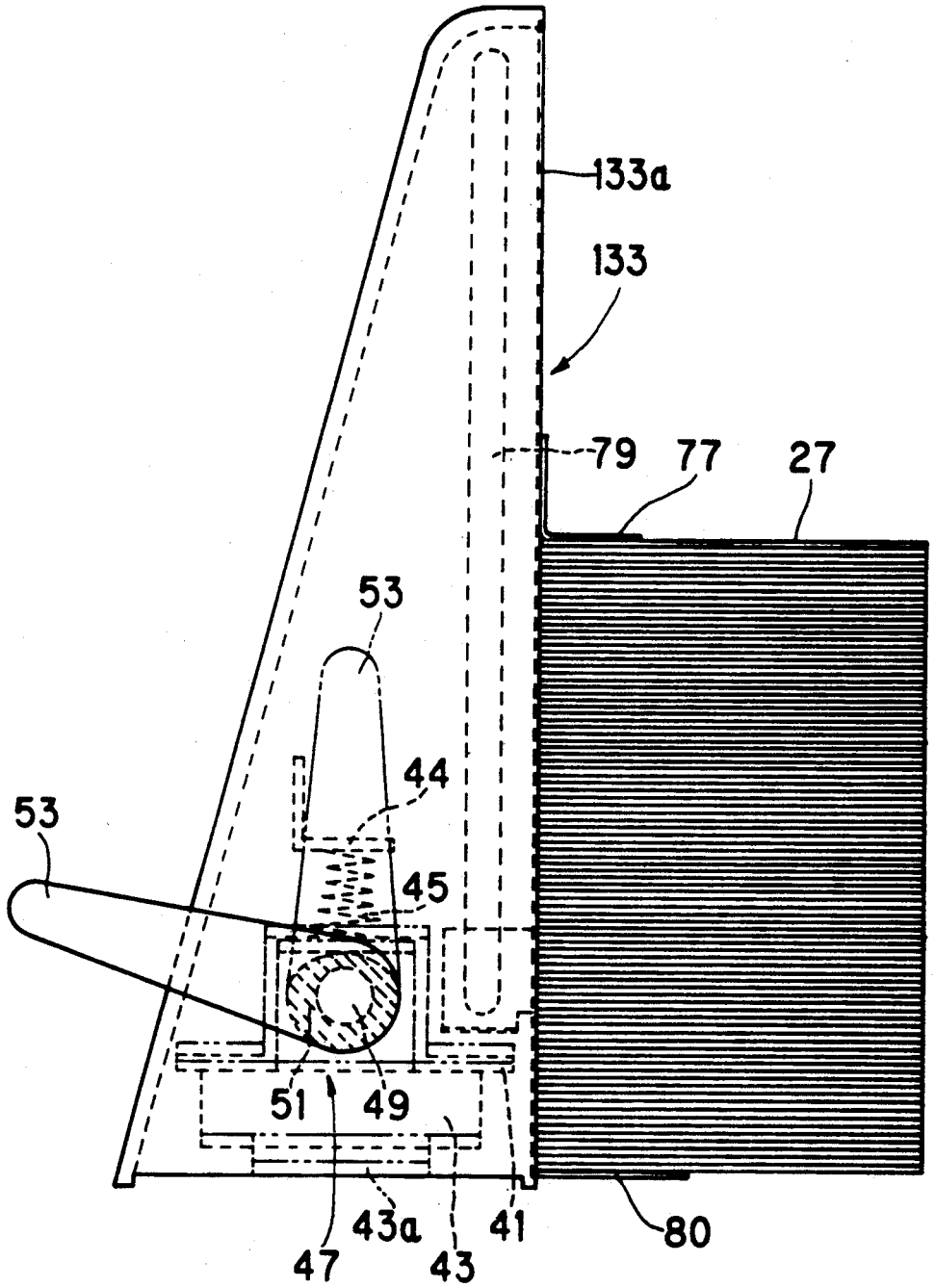
FIG. 10 is a side view of the stopper when it is taken out together with the stacked papers.

In this embodiment, stack full sensor 83 and magnet 87 similar to those of the previous embodiment, as shown in FIG. 7, are provided. However, in a case where this second paper press 77 is provided, the relative position between shutter 85 and sensor 83 is so adjusted such that the stack full position is detected when adhering member 89 of first paper press 75 adheres magnetic member 87*a* of magnet 87. In order to take stacked papers 27 out of paper receiver 35 after the stack full detection, if stopper 133 is taken out of stacker S while gently pressing the top portion of second paper press 77 by a hand, all the stacked papers can be taken out in a printed order without stacked papers 27 positioned on projection 80 at the lower portion of stopper 133 being disorganized (FIG. 10).

At this time, since tongue piece 77*a* of second paper press 77 sits on extension portion 75 of first paper press 75 simply by its weight, first paper press 75 does not hinder the take-out operation because it does not descend downward due to magnet 87.

During this operation, the stack operation and the printing operation are stopped because a stack full signal is emitted since shutter 85 shuts the light passage of stack full sensor 83. Thus, the paper take-out operation can be performed with ease.

As described above, in the stacker of the present invention, the position of the stopper can be adjusted at any place corresponding to the size of the stacked papers and the fixing or releasing operation of the stopper with respect to the bottom plate can also be performed with ease. And when the stopper is pulled out, all the stacked papers can be taken out in a printed order together with the stopper.

Moreover, even if the curly papers, having curly tendency imparted while it has been rolled up by a roller, is fed, they are stacked in a correct fashion since they are pressed along with the width and feed directions by the paper press.

Further, by adjusting the fixed position of the stack full sensor at a desirable position, the stack full height can also be adjusted at any height by which a stack full signal is generated to stop receiving the papers by detecting the height of the paper press.

Having described an illustrative embodiment of the invention with reference to the accompanying drawings, it is to be understood that the invention is not limited to such a precise embodiment, and that various changes and modifications may be effected therein by one skilled in the art without departing from the scope and spirit of the invention as defined in the appended claims.

What is claimed is:

1. A stacker, comprising:

a paper receiver equipped with a bottom plate;

a side plate;

a stopper positioned on the bottom plate for restricting a paper feed depth;

a paper feed means for feeding the papers into the paper receiver along an upper surface of the bottom plate, wherein the papers successively fed by the paper feed means are stacked from a bottom by a stopping thereof by the stopper;

a magnet means for releasably adhering said stopper upon said bottom plate, wherein said paper feed means is a feed belt provided along a paper feed direction in a manner such that a feed surface thereof projects slightly above the upper surface of the bottom plate; and a projection provided at a bottom of said stopper in a manner such that said projection extends along the feed surface without projecting thereabove.

2. A stacker in claim 1, wherein said bottom plate is made of a strong magnetic material and a magnet is provided at the bottom of said stopper for adhering to said bottom plate.

3. A stacker in claim 2, wherein said bottom plate is provided with one of a groove and a projection extending in parallel with the paper feed direction, said stopper is provided with one of a projection and a groove for respectively engaging one of said groove and said projection, wherein said stopper is made movable by respectively engaging one of said groove and said projection with one of said projection and said groove.

4. A stacker in claim 2, wherein said magnet is positioned movable along upward and downward directions within said stopper and a magnet position switch mechanism is provided to switch a position of said magnet either in an upper position for releasing said magnet from said bottom plate or a lower position for adhering said magnet close to said bottom plate.

5. A stacker in claim 4, wherein said magnet position switch mechanism includes an axis rotatably supported within said stopper, a cam fixed on said axis, a magnet holder for holding said magnet, a spring for engaging said magnet holder with said cam by a spring force thereof, and an externally operable lever fixed at one end of said axis, wherein said lever rotates said axis for a predetermined angle to thereby have said cam move said magnet holder in an upward direction or a downward direction.

6. A stacker in claim 1, further comprising a paper press means for pressing a top surface of the stacked papers positioned on said bottom plate of said paper receiver along both the paper feed direction and a direction traverse to said paper feed direction at a right angle and being provided at the side plate movably along upward and downward directions.

7. A stacker in claim 1, further comprising a first paper press means for pressing the stacked papers from an upper surface thereof and at least near the rear end thereof and being provided at the side plate movably along upward and downward directions, and a second paper press means for pressing the front end of said stacked papers operable together with said first paper press means and being movable along a paper touching surface of said stopper.

8. A stacker in claim 7, wherein said first paper press means has a main portion extended traverse to the paper feed direction at a right angle; an extension portion extending from said main portion along said side plate, and putting a tongue piece provided at said second paper press means on said extension portion.

9. A stacker of claim 7, wherein a downward position of said second paper press means is restricted such that said second paper press means does not descend further from a predetermined height above said bottom plate.

10. A stacker in claim 6, wherein said paper press means comprises:

a main portion extending traverse to the paper feed direction at a right angle;

an extension portion extending along said side plate;

an arm piece extending to outside through a slit provided at said side plate extending in a direction traverse to said bottom plate at a right angle;

a first ball bearing provided at said extension portion;

a first guide groove provided at said side plate and extending traverse to said bottom plate at a right angle, said first ball bearing being rotatably inserted in said first guide groove;

a second ball bearing provided at said arm piece;

a guide plate provided at an outside of the side plate extending traverse to said side plate at a right angle;

a second guide groove provided at said guide plate and extending traverse to said bottom plate at a right angle, said second ball bearing being rotatably inserted in said second guide groove.

11. A stacker of claim 10, further comprising a tension spring between said arm piece of said paper press means and said bottom plate.

12. A stacker of claim 6, further comprising a stack-full sensor for generating a signal to stop feeding papers into said paper receiver by detecting a position of said paper press means at a predetermined height and being supported at the side plate movably along upward and downward directions, and a sensor fixing means for fixing said sensor at a desirable height.

13. A stacker of claim 12, further comprising a magnet provided at a member for supporting said stack-full sensor in a movable fashion with respect to said side plate and an adhering member of a strong magnetic material provided at said paper press means, wherein said adhering member is to adhere to said magnet.

* * * * *